US005700420A

United States Patent [19]

Nakagawa et al.

[11] Patent Number: 5,700,420

[45] Date of Patent: Dec. 23, 1997

[54] NON-OXIDIZING HEATING METHOD AND APPARATUS

[75] Inventors: Tsuguhiko Nakagawa; Ryosuke Yamaguchi; Hisashi Osanai; Junichi Hasunuma; Takemi Yamamoto, all of Kurashiki, Japan

[73] Assignee: Kawasaki Steel Corporation, Kobe, Japan

[21] Appl. No.: 624,642

[22] PCT Filed: Dec. 4, 1995

[86] PCT No.: PCT/JP95/02470

§ 371 Date: Apr. 8, 1996

§ 102(e) Date: Apr. 8, 1996

[87] PCT Pub. No.: WO96/17215

PCT Pub. Date: Jun. 6, 1996

[30] Foreign Application Priority Data

| | | | |
|---|---|---|---|
| Dec. 2, 1994 | [JP] | Japan | 6-300044 |
| Dec. 2, 1994 | [JP] | Japan | 6-300045 |
| Jun. 30, 1995 | [JP] | Japan | 7-166207 |

[51] Int. Cl.[6] ..... F27D 7/02; B22D 11/10

[52] U.S. Cl. ..... 266/44; 266/139; 266/144

[58] Field of Search ..... 266/138, 139, 266/140, 144, 200, 44; 432/4

[56] References Cited

U.S. PATENT DOCUMENTS

| | | | |
|---|---|---|---|
| 3,738,795 | 6/1973 | Heuer | 266/140 |
| 4,718,643 | 1/1988 | Gitman | 432/4 |
| 4,818,844 | 4/1989 | Ward | 266/139 |

FOREIGN PATENT DOCUMENTS

| | | | |
|---|---|---|---|
| 62-124223 | 6/1987 | Japan . | |
| 62-164831 | 7/1987 | Japan . | |
| 0237949 | 2/1990 | Japan . | |
| 0422568 | 1/1992 | Japan . | |
| 0422567 | 1/1992 | Japan . | |
| 4263009 | 9/1992 | Japan . | |
| 4293714 | 10/1992 | Japan . | |
| 6281350 | 10/1994 | Japan . | |
| 388027 | 10/1973 | U.S.S.R. | 266/140 |
| 0985057 | 12/1982 | U.S.S.R. | 266/139 |
| 9617215 | 6/1996 | WIPO . | |

OTHER PUBLICATIONS

"4.2 Radiant Tube" on pp. 31–45 of Recent Progress of Combustion Technology in Iron and Steel Industry (Dec. 1990) edited by Japanese Iron and Steel Association.

"3.2 Direct Flame Heating Method" on pp. 89–94 of Heating Cooling Technique in Continuous Annealing in Progress in Continuous Annealing Technique of Strip (Dec. 1983) edited by the 88th Nishiyama Memorial Technical Lecture.

"Two–Layer Atmospheric Combustion Method" of Nippon Koh Kan Technical Bulletin No. 120 (Dec. 1988), pp. 24–30.

*Primary Examiner*—Scott Kastler

*Attorney, Agent, or Firm*—Dvorak & Orum

[57] ABSTRACT

A non-oxidizing heating method and apparatus in which a non-oxidizing gas of high temperature is continuously generated and supplied into a furnace by changing over a plurality of heat storage type heaters alternately while repeating an operation in which one heater stores heat and the other heater heats and blows the non-oxidizing gas. Since it is possible to heat by producing a completely non-oxidizing atmosphere within the furnace, the method and apparatus can be effectively utilized in furnaces which require heating in a non-oxidizing atmosphere, for example, various furnaces such as a ladle, tundish, etc. used in a field of steel manufacturing and continuous casting, and various furnaces used in a field of heating and heat treatment of metallic materials, and thus, it is effective to achieve reduction of operational cost, improvement of product quality, and improvement of product yield.

14 Claims, 8 Drawing Sheets

NON-OXIDIZING HEATING METHOD AND APPARATUS

TECHNICAL FIELD

The present invention relates to a non-oxidizing heating method and apparatus, and in particular, to a non-oxidizing heating technique using a non-oxidizing gas effective in furnaces of various types in a steel manufacturing and continuous casting field such as ladles, tundishes, and the like, and in furnaces of various types in a heating and heat treatment field for heating metallic (including non-ferrous metals) materials.

BACKGROUND ART

In the prior art, as methods of heating metallic materials such as a steel material and the like in a non-oxidizing state in a heating surface, the following methods are known including; (1) a radiant tube heating method ("Recent Practical Combustion Technique" (1983), p31, edited by Japanese Iron and Steel Association), (2) a direct flame reducing heating method (the 88th Nishiyama Memorial Technical lecture, (1983), p75), and (3) a two-layer atmospheric combustion method (Nippon Koh Kan Technical Bulletin, No.120 (1988), p24).

In the method of the present invention, the inside of a radiant tube disposed in a heating furnace is heated by combustion by a burner, and a steel material is heated by utilizing heat radiated from an outer surface of the tube. Accordingly, since an atmosphere within the furnace in contact with the steel material can be set at will, the atmosphere within the furnace can be easily made to be a non-oxidizing state.

Further to the invention, a reducing flame formed in an outer flame portion of a burner flame is made to directly collide with the steel material thereby to heat under a reducing atmosphere.

Finally, the steel material is wrapped in a non-oxidizing atmosphere produced by incomplete combustion, and at the same time, secondary combustion is caused in an unburned region existing in an outer portion of the non-oxidizing atmosphere so that the heating is performed by two-layer atmospheric adjustment.

The above-mentioned methods relate to the steel material, however, each of the above-mentioned methods is adopted in heating non-ferrous metals such as Al, Cu, and the like.

However, in the above-mentioned prior art non-oxidizing heating techniques for metallic materials, the following various problems are involved.

(1) Radiant Tube Heating

This method is excellent in the point that a combustion gas having an oxidizing property containing $H_2O$ produced by combustion and residual $O_2$ at the time of combustion can be completely isolated from the atmosphere in the furnace. However, 1) when a furnace temperature is at a high temperature equal to 1200° C. or higher, there is no tube which is effective to endure this temperature, and 2) there is a limitation to a combustion capacity (heating capability of the furnace) of a burner to achieve combustion in a narrow space within the tube. For this reason, except for a heat treatment furnace, the radiant tube method has not been used in the prior art for a heating furnace for rolling a steel material in which the furnace temperature exceeds 1200° C.

(2) Direct Flame Reducing Heating

In this method, since it is necessary to form a reducing atmosphere in the vicinity of the steel material, 1) there are limitations in operation such as a surface temperature (900° C. or lower), combustion conditions (load, air ratio, burner capacity), and the like, 2) there is a limitation in facility such as a distance between the steel material surface and the burner, and 3) thermal efficiency is not satisfactory, since only a part of combustion heat possessed by fuel is used. For these reasons, the direct flame reducing method has not been used for a heating furnace (heating furnaces for hot rolling, thick plate and strip steel, etc.) for rolling a steel material.

(3) Two-Layer Atmospheric Combustion

In this method, 1) since two-layer atmosphere is formed, there is a limitation in disposing a burner within a furnace (for example, it is difficult to use a roof burner and a side burner jointly), and in the case of heating a steel material of a large size, there is a problem in uniformity of heating temperature, 2) since heating capability/furnace volume is small as compared with a conventional burner, the size of the furnace becomes large, and 3) the non-oxidizing atmosphere is apt to be changed when a combustion load is varied, and the application of the two-layer atmospheric combustion method is difficult to a furnace in which a load variation is large. For these reasons, the two-layer atmospheric combustion method has not been used for a heating furnace for rolling large-sized steel materials such as hot rolling, thick plate and strip steel.

Furthermore, when obtaining the non-oxidizing atmosphere by combustion, the furnace temperature and combustion conditions (e.g., in order to obtain the non-oxidizing atmosphere at a steel material temperature >1200° C., it is necessary that the composition of combustion gas must meet the following relations; $CO/CO_2>3.1$ and $H_2/H_2O>1.2$, and in the case where a coke furnace gas is used as fuel, the fuel must be burnt to meet the relation; air ratio<0.5) are limited. As a result, there are many limitations in the operation so that it is difficult to obtain a complete non-oxidizing atmosphere in the vicinity of the steel material surface and still more, to continuously maintain the non-oxidizing atmosphere stably. Accordingly, it was difficult to sufficiently prevent oxidization.

Next, it wall be described as to a background technique relating to heating in a tundish which is one of the furnaces in a continuous casting field.

Since the tundish itself does not have a heat generating member, in using the tundish, it is necessary to heat by a heating means separately in order to maintain a casting enabling temperature. Furthermore, in the case where continuous casting as performed by using a plurality of tundishes and by exchanging one for another, for example, in changing the kind of steel, a tundish which is used at present is replaced by a stand-by tundish, and the tundish which has been used so far is made to stand by until it is re-used next time. In this case, for the re-used tundish, it is also necessary to heat to the casting enabling temperature. In either case, in the prior art tundish, generally the preheating is performed by using as a heating means a gas burner provided on a preheating cover of the tundish. More specifically, the gas burner is fed with a mixture of a fuel gas such as e.g., a coke gas and air of 110 to 120% of a theoretically required amount, and the mixture is burnt within the tundish thereby to heat an inner surface of the tundish beforehand to 1200° to 1300° C. However, in this case, since an excessive amount of oxygen is mixed into the fuel gas, when the preheated tundish is successively re-used, residual steel and reamnants in the previous use (previous charge) is oxidized at the time of preheating of the next charge, and FeO is produced (a phenomenon so-called as FeO pickup). Then, this produced FeO acts on Al which is a component in the steel, and $Al_2O_3$ is produced and it remains in the steel as an inclusion. As a result, in a down-stream process, quality defects such as swell and the like are resulted due to the $Al_2O_3$.

Heretofore, the development of a technique to prevent the FeO pickup has been sought, and various proposals have been made. For example, Japanese Patent Laid-Open Publication Hei No. 4-22567 discloses a tundish preheating method in which in re-using a continuous casting tundish, the amount of air supplied to a preheating gas burner is decreased to 70 to 100% of the theoretically required amount required for the amount of supply gas thereby to decrease an atmospheric oxygen concentration within the tundish smaller than the amount used in the prior art so as to suppress the oxidation of the residual steel.

Furthermore, Japanese Patent Laid-Open Publication Hei No. 2-37949 discloses a gas replacing technique within a tundish in which upon finishing preheating within the tundish, the feeding of fuel is stopped and at the same time, residual fuel in a burner is purged by an Ar gas which is an inert gas to burn within a preheating cover, and subsequently, a replacing Ar gas is fed by an Ar piping used exclusively for gas replacement thereby to perform replacement. Thus, the fuel gas within the tundish is replaced by the Ar gas in a short time to suppress oxidation of residual steel.

However, the techniques disclosed in Japanese Patent Laid-Open Publication Hei No. 2-37949 and Japanese Patent Laid-Open Publication Hei No. 4-22567 are basically based on a prior art method in which in order to ensure a casting enabling temperature at the time of using a tundish, an inner wall is preheated to 1200° C. to 1300° C. by burning a fuel gas mixed with air within the tundish. Under the premise of this prior art method, in the technique in Japanese Patent Laid-Open Publication Hei No. 2-37949, in particular, in order to suppress as far as possible the problem of oxidation of the residual steel at the time of preheating in the case where a re-use tundish is used, a method is adopted in which after finishing the preheating, an inert gas is specially blown into the tundish to purge the fuel gas and remaining oxygen thereby to replace by a non-oxidizing atmosphere. It is true that the remaining of the combustion gas and oxygen is improved by forcibly purging by the inert gas and that the period of time until completion of the gas replacement after preheating can be shortened more or less. However, there is a problem in that it is impossible to prevent also the oxidation of reamnants due to excessive oxygen during heating, and that the inner wall temperature of the tundish is lowered by the gas purge and heat loss is resulted.

In contrast, in the technique of Japanese Patent Laid-Open Publication Hei No. 4-22567, the oxidation of residual steel is suppressed without performing the purge by inert gas, instead by decreasing the amount of air supplied to the preheating gas burner to an amount equal to the theoretically required amount of air or less, and thus the problem as in the former will not be caused. However, since it is necessary to decrease the theoretically required amount of air for the burner to 50% or less in order to completely prevent the oxidation, there arises another problem of incomplete combustion due to insufficient oxygen during combustion, and the heating cost increases to a great extent. In addition, there is a problem in that a safety measure is needed in treating unburned gas to prevent explosion and intoxication by CO.

The present invention relates to heating of various kinds of furnaces which require heating in a non-oxidizing atmosphere in a field of heating and heat treatment of metallic materials and in a field of steel manufacturing and continuous casting, and the present invention was made in view of the problems in the above-mentioned prior art. A first object of the present invention is to provide a non-oxidizing heating method and apparatus in which by heating by continuously feeding a non-oxidizing gas of high temperature, oxidation of an object to be heated is completely prevented, and effective utilization of heat can be achieved, and furthermore, there is no fear of incomplete combustion and intoxication.

Furthermore, the present invention aims to establish a technique which can overcome the respective problems in each of the prior art techniques individually, and it is a second object to provide a non-oxidizing heating method and apparatus in which the scale loss is decreased and the yield is improved by preventing or suppressing the oxidation during heating, and still, the treatment of descaling becomes easy through the suppression of the oxidation thereby to reflect on costs.

Furthermore, it is a third object of the present invention to realize a low cost and non-oxidizing heating operation by providing an effective means for generating a non-oxidizing gas of high temperature, and in particular, by forming a steel material heating atmosphere by obtaining a non-oxidizing gas which is preheated to a temperature equal to or higher than a steel material temperature during heating or substantially equal to a furnace temperature by heat exchange with a combustion gas within the furnace.

DISCLOSURE OF INVENTION

In the non-oxidizing heating method of the present invention, in heating the inside of a furnace which requires a non-oxidizing atmosphere by a high temperature non-oxidizing gas, the operation to heat the non-oxidizing gas to a predetermined temperature is repeated while changing over a plurality of heat storage type heaters alternately thereby to continuously generate the high temperature non-oxidizing gas. By virtue of this, the existence of even a small amount of oxidizing gas is eliminated, and the high temperature non-oxidizing gas is supplied into the furnace without interruption, and the oxidation of an object to be heated is completely prevented.

Here, a part of the high temperature non-oxidizing gas is re-circulated to re-use for the heating of the inside of the furnace. Thus, it is possible to effectively utilize the heat.

Furthermore, the high temperature non-oxidizing gas which is supplied into the furnace is generated by heat exchange with the combustion gas within the furnace, which heat exchange being performed through a heat storage type heater. By virtue of this, waste heat of the combustion gas within the furnace, which has been discharged wastly in the prior art is positively utilized, and the non-oxidizing heating operation at low cost is realized.

The non-oxidizing heating method of the present invention is applied to heating of a tundish as a furnace which requires a non-oxidizing atmosphere. By virtue of this, it is possible to omit the preheating by the combustion gas within the furnace by using a preheating burner, which preheating has been performed in the prior art at the time of re-using the tundish having residual steel formed on an inner wall in particular, and the oxidation of the residual steel is completely prevented and a so-called FeO pickup is prevented, thereby to prevent occurrence of quality defects of a product steel.

In this case, the heat within the tundish is preserved by using a non-oxidizing gas which has been heated to 850° C.

or higher by a heating means external to the tundish, and the tundish is used next time. Accordingly, a stand-by enabling time at the time of re-using the tundish is extended to a great extent, and the number of successive uses is increased.

Furthermore, the non-oxidizing heating method of the present invention is applied to a heating furnace of steel materials as a furnace which requires a non-oxidizing atmosphere. By virtue of the this, it is possible to omit the prior art heating methods of heating furnace such as the radiant tube method, the direct flame reducing heating method, and the two-layer atmosphere combustion method in which sufficient oxidation prevention was difficult due to many limitations such as combustion conditions and the like, and the atmosphere on the steel material surface within the heating furnace is stabilized to maintain a complete non-oxidizing atmosphere, and the scale loss is decreased and the yield of products is improved.

In this case, the high temperature non-oxidizing gas which has been preheated to the steel material temperature or higher during heating, or preheated to a temperature substantially equal to the furnace temperature is supplied. By virtue of this, the drop of furnace temperature and steel material temperature is prevented to improve the thermal efficiency.

Furthermore, in this case, in a heating zone or a uniform heating zone in which the steel material surface temperature exceeds 700° C., either method of blowing a high temperature non-oxidizing gas into the vicinity of the steel material to surround the steel material to be heated, or replacing the oxidizing gas within the furnace by the blown-into gas is used. By virtue of this, the steel material to be heated is isolated from the oxidizing gas atmosphere within the furnace, and the improvement in the yield due to the reduction of scale loss of the steel material is promoted.

Furthermore, the non-oxidizing heating method of the present invention is applied to an annealing furnace as a furnace which requires a non-oxidizing atmosphere. By virtue of this, convection heat transfer heating by a high temperature gas jet is performed in place of indirect heating by a conventional radiant tube burner, and the controllability of plate temperature of materials to be heated such as, for example, a strip is remarkably improved.

In the non-oxidizing heating method of the present invention, an inert gas, or a mixed gas produced by mixing the inert gas with trace amounts of reducing gas equal to or less than a combustible limit is used as the non-oxidizing gas, and this gas is introduced into the furnace thereby to change the atmosphere within the furnace to a non-oxidizing or reducing atmosphere. In this case, as the inert gas, $N_2$ or Ar is used independently, or used by mixing them, and as the reducing gas, $H_2$ or CO is used independently, or used by mixing them. By making the atmosphere within the furnace become a non-oxidizing or reducing atmosphere, the oxidation preventing action is made to be mope complete, and on the other hand, the reduction of an oxide is made to be possible, and at the same time, the fear of explosion due to leakage or the like of gas within the furnace is eliminated.

The non-oxidizing heating apparatus of the present invention is a non-oxidizing heating apparatus of a heat storage type which heats a non-oxidizing gas supplied into a furnace which requires a non-oxidizing atmosphere, and the apparatus comprises heat exchangers, a set of the heat exchangers being formed by at least two heat exchangers, each having a heat storage member and a heating means, and a changeover valve to connect the heat exchangers with a supply line of an unheated non-oxidizing gas. Either one of the heat exchangers is made to be a heat storage system which heats the heat storage member, and the other is made to be a blower system which heats the non-oxidizing gas and blows out, and a high temperature non-oxidizing gas is continuously generated by heat exchange while both the systems are changed over by the changeover valve. By virtue of this, the high temperature non-oxidizing gas produced by the heat exchange is reliably and continuously supplied into the furnace thereby to prevent oxidation of the object to be heated.

The non-oxidizing heating apparatus of a heat storage type is further provided with a gas circulating fan, and a heated gas circulating path is provided so that a suction side of the fan is connected to the inside of the furnace and a discharge side is connected to the unheated non-oxidizing gas supply line. Thus, the recycling of the heated gas is made possible, and the effective utilization of heat is promoted.

In the non-oxidizing heating apparatus of the present invention, as the heating means for the heat storage member, any one is selected from a gas fuel burner, a liquid fuel burner, an electric resistance heater, an induction heater, and a plasma torch. By virtue of this, the apparatus is optimumly adapted to conditions of the object to be heated.

Furthermore, different from the heating means mentioned above, by using a combustion gas within the furnace as the heating means for the heat storage member, the energy consumption is saved by effectively utilizing waste heat.

Furthermore, in the non-oxidizing heating apparatus of the present invention, other than the sole non-oxidizing gas, a mixed gas produced by mixing the non-oxidizing gas with trace amounts of reducing gas equal to an explosion limit or less may be used. By virtue of this, the atmosphere within the furnace is made to have a reducing property, and the prevention of oxidation of the object to be heated is made to be more complete.

BEST MODE FOR CARRYING OUT INVENTION

Figure 1:
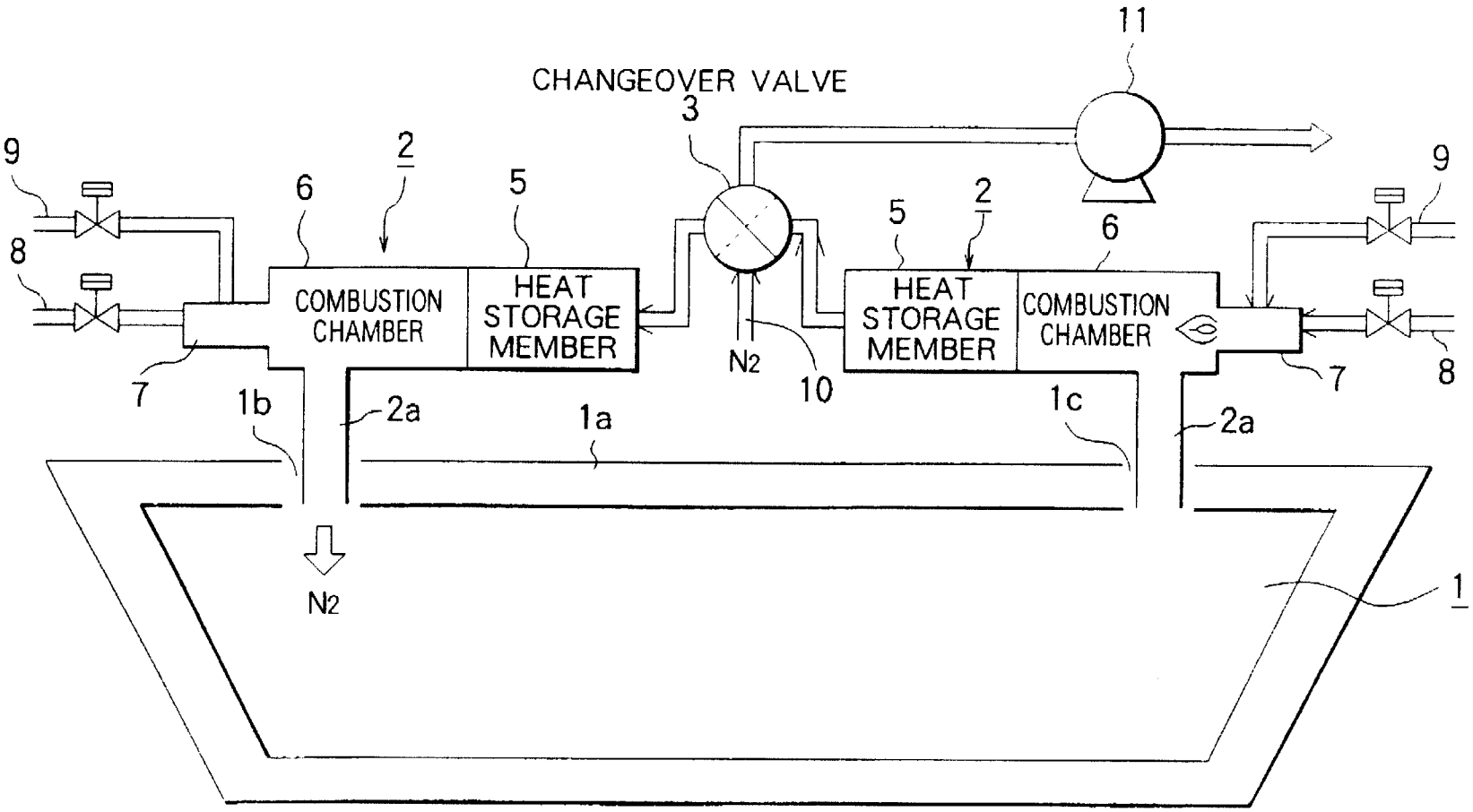
FIG. 1 is a conceptual diagram showing one embodiment in which the present invention is applied to a non-oxidizing heating of a tundish.

The inventors of the present application, in selecting as a thema the heating of a furnace which requires a non-oxidizing atmosphere, first, aimed to solve the problems in the prior art relating to preservation of casting enabling temperature of a re-use tundish. In order to solve the problems in the prior art, it is considered necessary to realize a process to re-use the tundish without performing combustion within the tundish, that is, a non-preheating, non-oxidizing re-use process, and the inventors have continued the study while conducting various experiments towards the realization.

According to the experiments by the inventors, normally, the temperature of a tundish inner surface during casting rises to about 1540° to 1570° C. which is substantially equal to a steel melting temperature. However, the temperature drop begins simultaneously with completion of the casting, and if the tundish is made to stand-by as it is, for example, in the case of a tundish of 70t, the temperature will drop below 1100° C. after elapsing about 6 hours, and will drop below 850° C. after elapsing 14 hours.

If the temperature is below 850° C., it is difficult to pour the melted steel transferred from a ladle into a casting mold through a nozzle at a bottom of the tundish, even if bubbling (so-called enema) is done by blowing oxygen into the nozzle from a lower end of the nozzle. Furthermore, when the temperature of the tundish which is standing-by drops, since the amount of temperature drop of the melted steel becomes large when the melted steel is poured into the tundish, it is necessary to raise the temperature of the melted steel at the time of pouring in order to maintain a melted steel temperature at an initial stage of the casting. However, at a later half stage of the casting, since the temperature of the tundish rises, the melted steel temperature rises too high higher than needed, and this becomes a cause of decreasing a casting rate and causing break out. Accordingly, it was also confirmed by the experiments that the temperature of 850° C. is practically the lower limit of the temperature during re-use of the tundish which is standing by.

In addition, when an inner pressure of the tundish decreases due to temperature drop, and outer air (oxygen) intrudes into the tundish, the oxygen concentration within the tundish increases. It has been found out that in order to prevent oxidation of residual steel in re-using of the tundish, it is necessary to decrease the oxygen concentration within the tundish which is standing by to 1% or less. Accordingly, in order to prevent the intrusion of oxygen due to the temperature drop of the tundish which is standing by without performing the purge of gases within the tundish by using a non-oxidizing gas, the tundish must be substantially completely sealed. The afore-mentioned data as to the temperature drop of the tundish which is standing by is a value in this sealed state.

Moreover, even if in the completely sealed state, for example, since the gases within the tundish are contracted due to the temperature drop, and also since a draft action occurs due to the high temperature within the tundish, the intrusion of air from the outside occurs, and the air intrusion cannot be decreased to zero. Accordingly, since it is practically impossible to decrease the intrusion of air into the tundish from the outside to zero, it is difficult to achieve the complete non-oxidation solely by sealing completely. It is considered as a counter measure to continuously purge by a non-oxidizing gas (e.g., $N_2$ gas) to prevent intrusion of oxygen from the outside of the tundish. According to the experiments conducted by the inventors to study its possibility with respect to a tundish of 70t, a temperature drop in the case of stand-by while supplying an $N_2$ gas continuously at a rate of 120 $Nm^3/H$ was rapid as compared with the case without the aforementioned purge, and it was found that the temperature drops to 1100° C. in 3 hours, and to 850° C. after 8 to 9 hours.

The inventors, based on these results, found out that in re-using the tundish, if the inner surface temperature of the tundish is maintained at 850° C. or higher which is the low limit of the casting enabling temperature by supplying a non-oxidizing gas which is heated outside the tundish, it is possible to re-use the tundish while preventing oxidation without preheating, and thus, the present invention was completed.

The heating means of the non-oxidizing Gas is not limited especially, however, it is preferable to use, for example, a heat storage type preheater which uses as a heating source of the gas a heat storage member heated by a gas burner, or to use electric resistance heating, induction heating, or electric heating utilizing a plasma torch.

Hereinafter, embodiments of the present invention will be described with reference to the drawings.

FIG. 1 is a conceptual diagram showing one embodiment of an apparatus for implementing a non-oxidizing heat preserving method of a tundish of the present invention.

In FIG. 1, the reference numeral 1 denotes a 4-successive casting tundish (T/D) having a capacity of 70 t. In this respect, sliding nozzle and immersed nozzle provided at a bottom portion of the tundish are omitted to show in FIG. 1. Heat storage type preheaters 2 and 2 which are heating means of a non-oxidizing gas are respectively connected to apertures 1*b* and 1*c* of a cover 1*a* of the tundish 1. These two units of heat storage type preheaters 2 and 2 are coupled with each other through a changeover valve 3.

Each heat storage type preheaters 2 is provided with a heat storage chamber 5 filled with a heat storage member consisting of, e.g. ceramics or metal in the shape of balls or pipes to have a large heat transfer area, a combustion chamber 6 for burning a fuel gas to heat the heat storage member, a burner 7 placed in the combustion chamber 6, and a fuel supply line 8 and air supply line 9 led to the burner 7.

The changeover valve 3 has a function to change over paths to feed a non-oxidizing gas (e.g. $N_2$, Ar) supplied from a non-oxidizing gas supply line 10 to one heat storage type preheater 2 or the other heat storage type preheater 2 thereby to feed into the inside of the tundish 1, and to change over paths to receive a gas and a combustion exhaust gas taken out from the inside of the tundish 1 through either one of heat storage type preheaters 2 and 2 thereby to exhaust to the outside through an exhaust fan 11.

In this respect, the changeover valve (device) is not limited to a 4-way changeover valve 3 as shown in figure provided that the changeover function of the paths described above is satisfied, and a combination of changeover valves may be used.

A non-oxidizing heating experiment of the tundish 1 was conducted by using the apparatus shown in FIG. 1 and using an N2 gas as the non-oxidizing gas.

(1) The experiment of heat preservation in the inside of the tundish in which the cover la is mounted on the tundish 1 after it has been used for the first time, and a high temperature heated $N_2$ gas which is heated to 1300° C. is continuously supplied by alternately changing over the two units of heat storage type preheaters 2 and 2:

In this case, a fuel gas is supplied through the fuel supply line 8 and air is supplied through the air supply line 9 to the burner 7 of the heat storage type preheater 2, and the supplied fuel gas and air are burnt in the combustion chamber 6 to generate heat of $70\times10^4$ Kcal/Hr thereby to heat the heat storage member in the heat storage chamber 5. Thereafter, the operation of the burner 7 is stopped, and an $N_2$ gas is fed at a flow rate of 1800 $Nm^3$/Hr from the outside through the changeover valve 3, and it is heated to a temperature of 1300° C. or higher through the heat storage member which has been heated, and the high temperature heated $N_2$ gas is fed into the tundish 1. While one heat storage type preheater 2 is being used to heat the $N_2$ gas, the other heat storage type preheater 2 is used to heat the heat storage member.

In this heat storage member heating process, a burnt gas in the combustion chamber 6 is sucked and exhausted by the exhaust fan 11 through the changeover valve 3. For example, a gas of total 1600 to 2000 $Nm^3$/H including the combustion exhaust gas and the $N_2$ gas sucked from the tundish 1 heats the heat storage member, and thereafter, the temperature thereof drops to 200° to 300° C. at the outlet side of the heat storage member, and then, forcibly exhausted.

The high temperature heated $N_2$ gas fed into the tundish 1 blows out and leaks out to the outside from gaps and apertures **1*b* and 1*c*, and the like of the cover 1*a* of the tundish 1, however, since the inner pressure of the tundish 1 is maintained somewhat higher than the outer air pressure, the intrusion of outer air into the inside of the tundish 1 is prevented. Furthermore, 20 to 60% of the amount of $N_2$ gas of 1800 $Nm^3$/Hr supplied from the outside into the inside of the tundish 1 is recycled through a nozzle 2*a*, and the recycled $N_2$ gas is used to control the temperature by decreasing a flame temperature (normally about 1900° C.) of the burner 7 and preventing abnormal temperature rise of the combustion chamber 5**, and at the same time, waste heat of the $N_2$ gas is recovered.

The heating of the $N_2$ gas is repeated alternately every 60 seconds by using the two units of heat storage type preheaters 2 and 2, and the high temperature heated $N_2$ gas of 1300° C. or higher is continuously supplied to the inside of the tundish 1. Thus, it was possible to make the tundish 1 stand by until the start of re-use while maintaining the temperature of the inner surface of the tundish 1 at 850° C. or higher to preserve the heat and while maintaining the inside of the tundish 1 in a non-oxidizing atmosphere.

In this case, at the time of changing over the heat storage type preheaters 2 and 2, even after the burner 7 of one heat storage type preheater 2 is extinguished, by continuing the forcible exhaust of the inside of the combustion chamber 6 by the exhaust fan 11 for a predetermined period of time, a part of the $N_2$ gas in the inside of the tundish 1 is exhausted from a high temperature $N_2$ gas inserting tube **2*a* of the heat storage type preheater 2 passing through the combustion chamber 6, heat storage chamber 5, and changeover valve 3. Accordingly, the combustion gas remaining in the combustion chamber 6, heat storage chamber 5, and changeover valve 3 can be replaced by purging with the non-oxidizing gas. Thus, in this manner, if the mixing of the remaining combustion gas into the tundish 1 which is generated at the initial stage of using by changing over is prevented, it is also possible to maintain the inside of the tundish 1** completely in the non-oxidizing atmosphere.

(2) The effect of extension of stand-by enabling time of tundish whose heat is preserved in non-oxidizing state:

Next, by using the apparatus of FIG. 1, the effect of extension of stand-by enabling time of tundish is obtained by comparing with the prior art, in which the tundish just after use initially retains an inner surface temperature of 1300° C. or higher, and a heated $N_2$ gas heated to 850° C. is continuously fed into the tundish to preserve heat in a non-oxidizing state.

Figure 2:
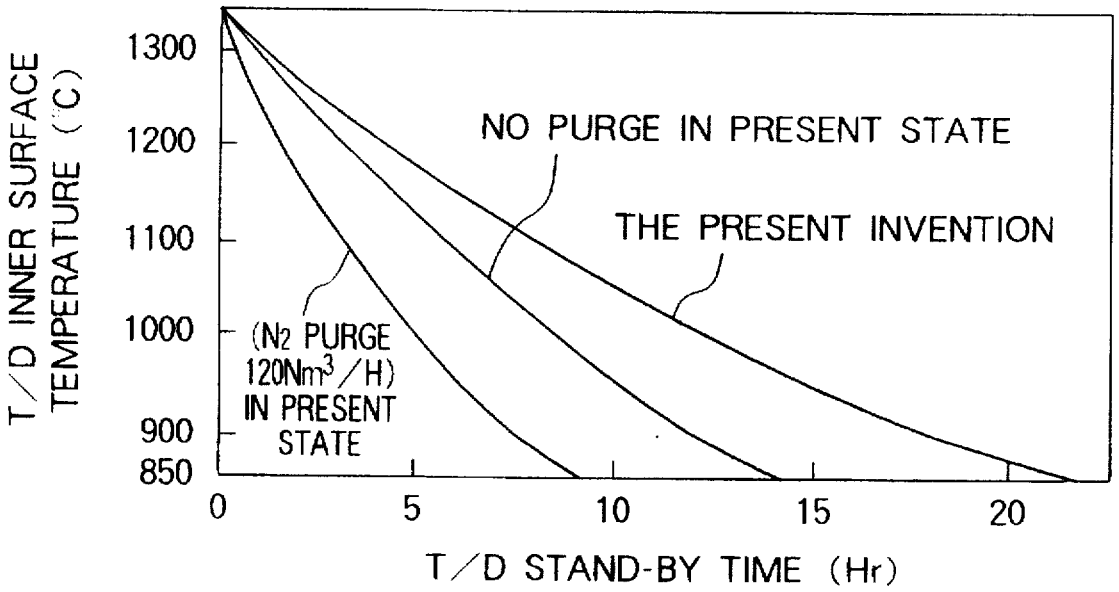
FIG. 2 is a graph showing a comparison of the prior art with an extension effect of a stand-by enabling time period as the tundish in the non-oxidizing heating in FIG. 1.

The result is shown in a graph in FIG. 2.

The curve "with purge in present state" shows a change of a tundish inner surface temperature in the case where a tundish having an inner surface temperature of 1350° C. is covered with a cover, and the tundish is made to stand by while supplying an $N_2$ gas at a normal temperature at a flow rate of 120 $Nm^3$/H to purge the inside of the tundish. The stand-by time until the temperature becomes a casting enabling low limit temperature of 850° C. is 8 to 9 hours.

In contrast, according to the method of the present invention, a non-oxidizing gas of 1300° C. is supplied to a tundish having an inner surface temperature of 1350° C. to preserve heat, and thus, the stand-by time can be extended to a great extent as long as 24 hours, and the number of successive castings can be increased.

(3) Non-oxidizing heat preservation with introduction of trace amounts of reducing gas:

In the apparatus shown in FIG. 1, the non-oxidizing gas supply line 10 is connected to a reducing gas supplying line not shown, and together with a non-oxidizing gas, any of reducing gases (may be replaced by LPGT, etc.) such as $H_2$, CO, $CH_4$, and the like is introduced into the tundish 1 by trace amounts, and the heat is preserved while maintaining the atmosphere within the tundish 1 to have a reducing property. Here, the trace amounts means an amount which is capable of preventing explosion when the reducing gas leaks to the outside of the tundish, that is, an amount equal to or smaller than a combustible limit of the reducing gas. For example, in the case of $H_2$, a concentration of 4% or less, and in the case of CO, an amount of 12.5% or less is mixed with the non-oxidizing gas to preserve the heat within the tundish 1.

By virtue of this, the atmosphere within the tundish became a reducing atmosphere, and there was no fear of explosion at the time of leakage, and the oxidation of residual steel was also prevented more completely.

Figure 3:
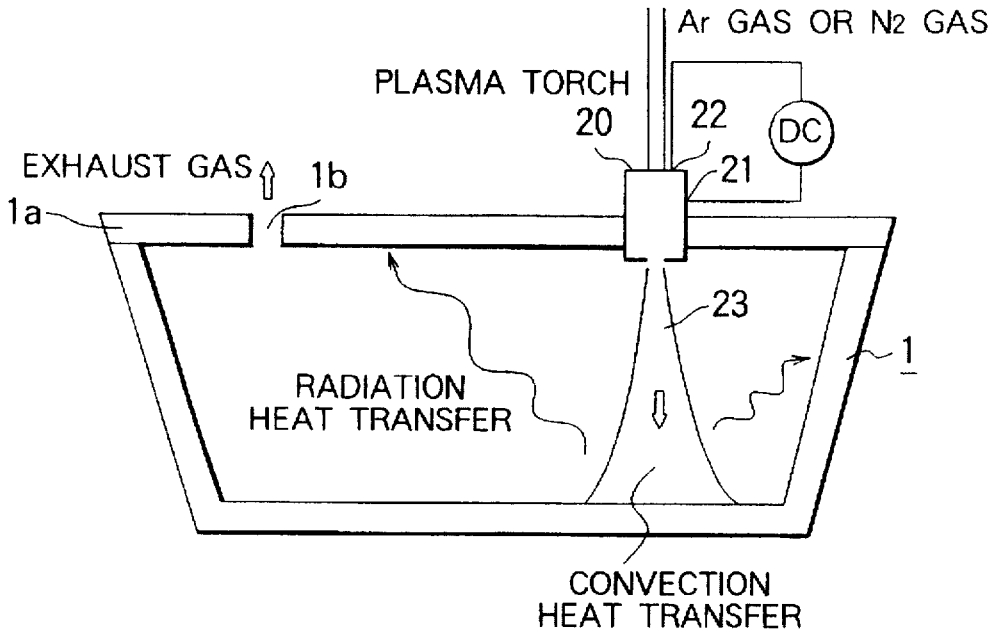
FIG. 3 is a conceptual diagram showing another embodiment of the tundish non-oxidizing heating.

FIG. 3 shows another embodiment of a heating means of a non-oxidizing gas for non-oxidizing heat preservation of a tundish.

In this case, a non-transfer type plasma torch 20 is used as the heating means of the non-oxidizing gas. The plasma torch 20 of this type has an anode 22 together with a cathode 21 in the torch itself, and a non-oxidizing gas flow supplied to the torch through the cathode 21 is transformed into plasma due to discharge between both the electrodes 21 and 22, and an inner wall surface of the tundish 1 is heated by high temperature plasma 23 thus produced. As a plasma gas, Ar, $N_2$, or the like is used, and it is possible to jointly use an HN gas (a mixed gas of $H_2$ and $N_2$).

In a general plasma jet heating, a plasma temperature of 3000° to 10000° C. is used, however, in the present invention, by convoluting an atmospheric gas within the tundish 1 into a plasma jet, a high temperature jet gas whose temperature is lowered to 2000° C. or lower is produced and used, and the heating is performed in a non-oxidizing atmosphere at a temperature of 1000° to 1300° C. In other words, the non-oxidizing gas fed into the tundish 1 is transformed into plasma by the plasma torch 20 mounted on the cover 1*a* of the tundish 1, and the plasma is blown onto the bottom of the tundish 1. The heat transfer at the time of this heating is in the form of convection transfer from the high temperature gas flow and radiation heat transfer from the heated bottom surface of the tundish to the other surfaces.

However, in the case of plasma jet heating, in order to reduce running costs, the heating is performed only for a time period required to ensure a tundish inner surface temperature of 1300° C. prior to the re-use of the tundish, and during other stand-by time period, non-preheating stand-by is performed.

Figure 4:
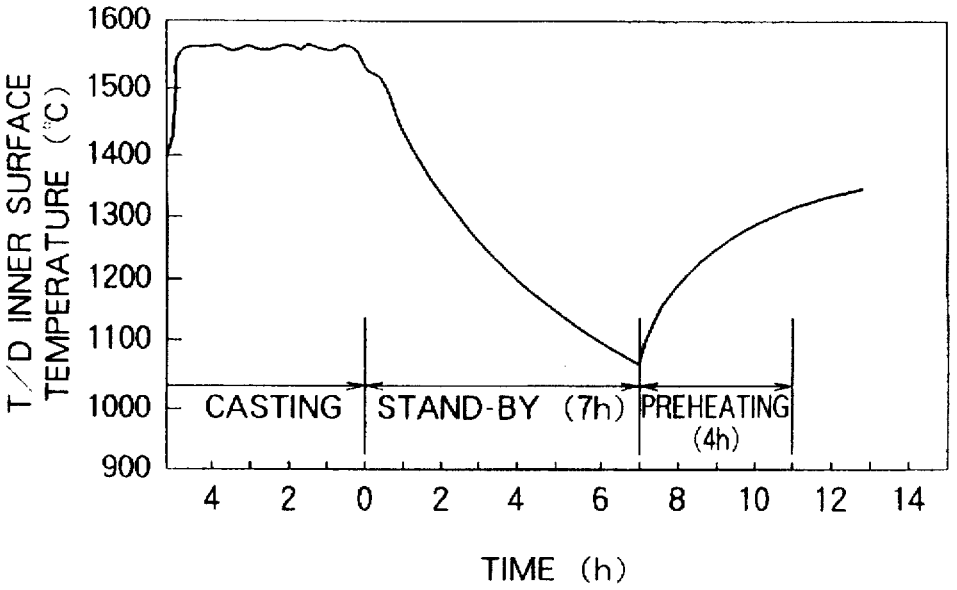
FIG. 4 is a graph showing a change of a tundish temperature in the tundish non-oxidizing heating.

FIG. 4 shows a result of non-oxidizing heat preservation experiment of a tundish by using the plasma torch 20.

The tundish whose temperature has been 1570° C. during casting is made to stand by with no preheating (non-preheating stand-by), then, the tundish inner surface temperature dropped to 1100° C. or lower in a stand-by time period of 7 hours. Subsequently, non-oxidizing heating within the tundish is started by N2 gas plasma jet using the plasma torch 20, and after 4 hours, the tundish inner surface temperature reaches to a target temperature of 1300° C. to enable to re-use. The total stand-by time is 11 hours, and during this time period, it was possible to perform casting of 16 charges each requiring 40 minutes by using other tundishes.

In the embodiment described above, it is described as to the case where the plasma torch is used as a means for electrical heating of the non-oxidizing gas in the non-oxidizing heat preserving method of the tundish, however, other means such as an electric induction heater, or an electrical resistance heater may be used.

Figure 5:
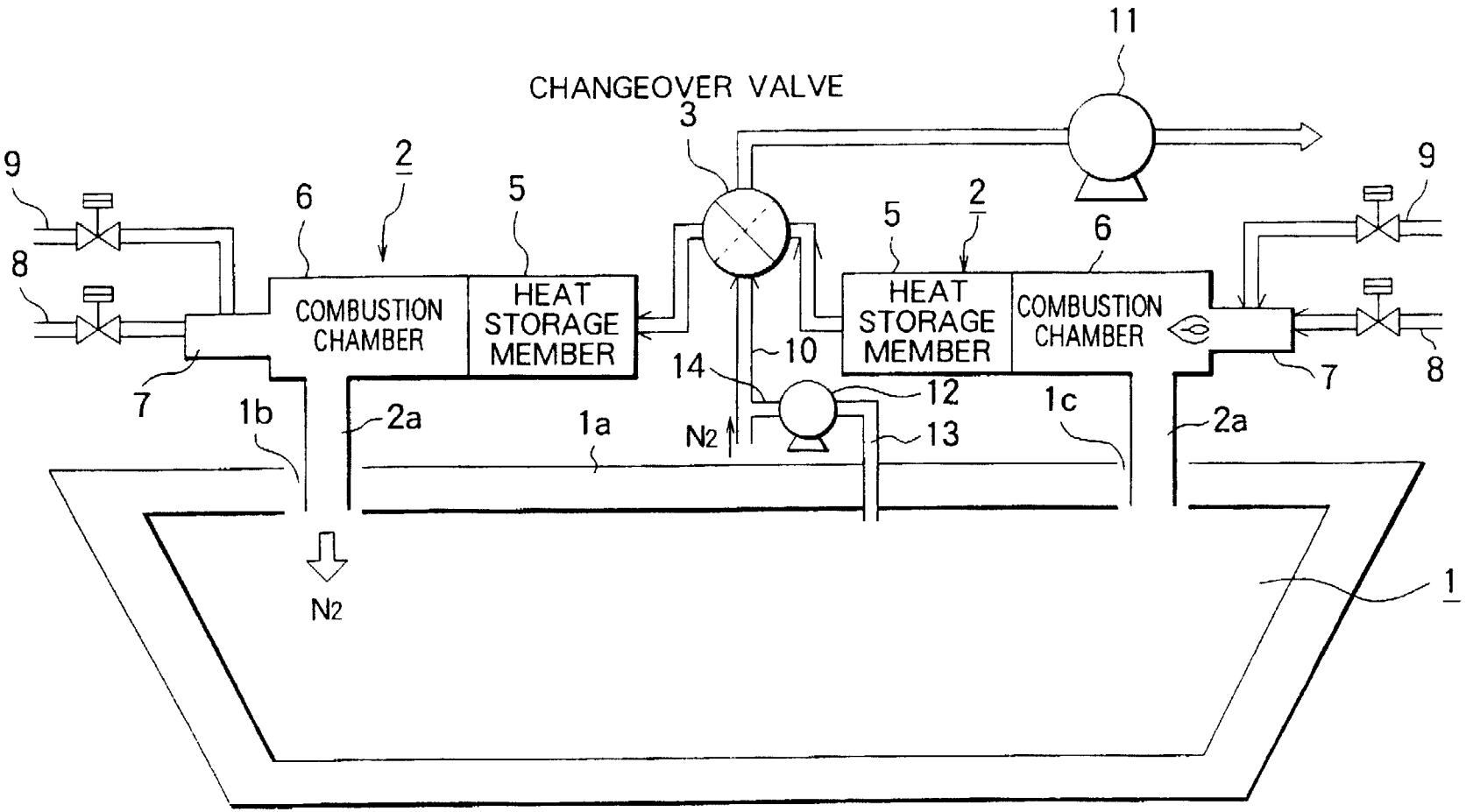
FIG. 5 is a conceptual diagram showing an embodiment in which a high temperature non-oxidizing gas within the tundish is recycled in the tundish non-oxidizing heating.

FIG. 5 shows another embodiment.

This embodiment is an example of non-oxidizing heating of a tundish by using a part of heating gas by recirculating.

In a facility similar to that shown in FIG. 1, as shown in FIG. 5, a circulating fan 12 is provided to circulate a high temperature $N_2$ gas present within a tundish 1. A suction side piping 13 of the fan 12 is inserted through a cover 1*a*, and at the same time, a discharge side piping 14 is connected to an $N_2$ gas supply line 10.

In this manner, a part of the high temperature $N_2$ gas within the tundish 1 is drawn out by the circulating fan 12, and it is fed into the $N_2$ gas supply line 10 to recycle. By virtue of this, a part of waste heat can be recovered, and the heat efficiency of the system can be improved.

In this case, the suction side piping 13 of the circulating fan 12 may be connected to a nozzle (not shown) at a bottom portion of the tundish 1. In such a case, since a part of the high temperature $N_2$ gas passes through the nozzle, there is an advantage that heat preservation of the nozzle can be made at the same time.

Figure 6:
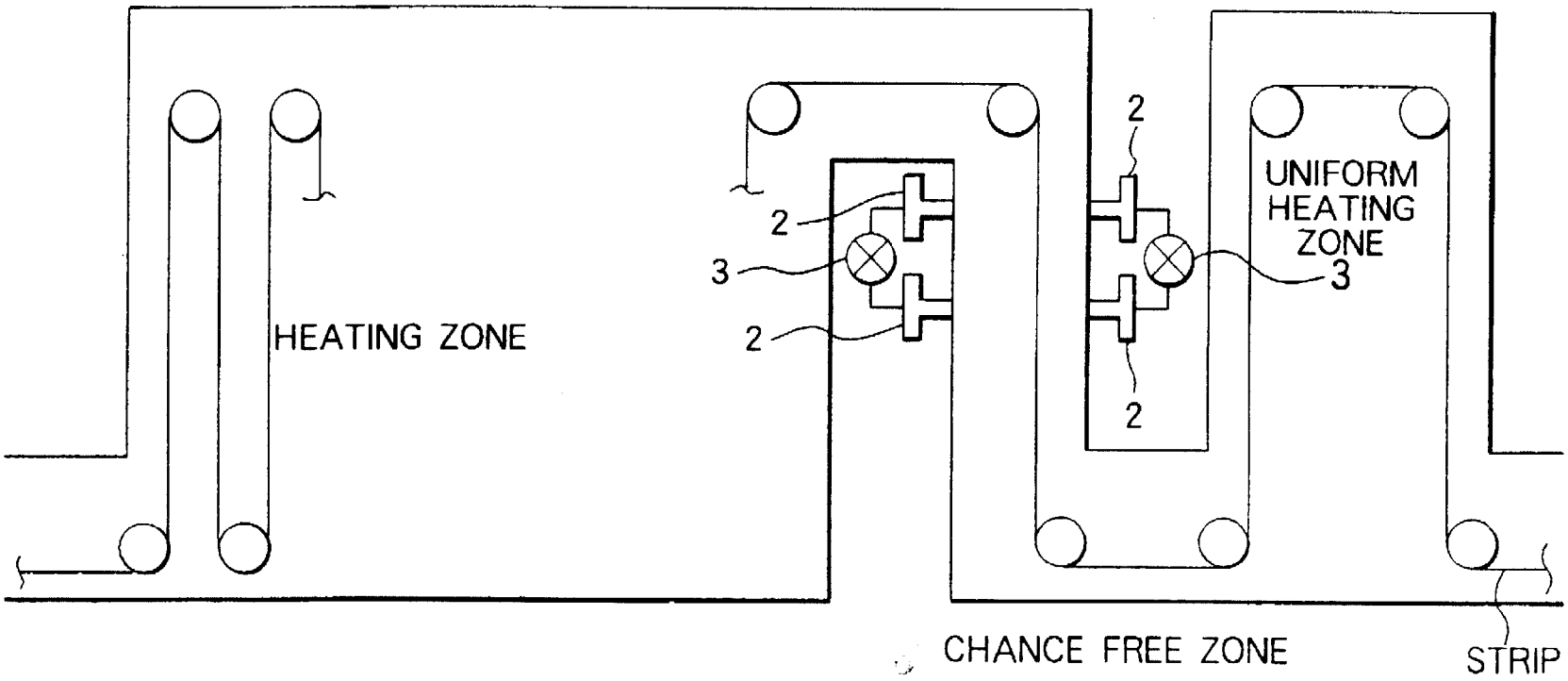
FIG. 6 is a conceptual diagram showing an embodiment in which the present invention is applied to non-oxidizing heating of an annealing furnace.

FIG. 6 shows still another embodiment.

In this embodiment, the heat storage type preheater 2 is applied to a non-oxidizing heat source of a strip annealing furnace.

The heating of a conventional annealing furnace is an indirect heating by radiant tube burner, however, by heating with a high temperature HN gas by applying a method of the present invention in which a plurality of heat storage type preheaters 2 are changed over alternately, the convection heat transfer heating by high temperature gas jet becomes possible. As a result, the controllability of a plate temperature is improved remarkably. This time, it is used in a chancefree zone, however, it may be used in a part of a heating zone.

In each of the embodiments described above, the object to be heated by non-oxidizing heating is the tundish and the annealing furnace, however, in place of the $N_2$ gas in each of the embodiments described above, by using an HN gas (a mixed gas of $H_2$ and $N_2$), the present invention is also applicable to a heating furnace for a steel material which is the object to be heated.

Here, next, it will be described as to a technique of non-oxidizing heating of a steel material of the present invention in which the scale loss generated by oxidation during heating of the steel material in a heating furnace is prevented, and the yield can be improved.

The technical characteristic feature in this case resides in that a locally non-oxidizing atmosphere is produced around the steel material loaded into the heating furnace, and that an inert gas such as $N_2$ or Ar, or a reducing gas containing $H_2$ or CO gas equal to a combustible limit or lower, or a high temperature non-oxidizing gas which is a mixed gas of the inert gas and the reducing gas is blown around the steel material to isolate the steel material from an oxidizing combustion gas within the furnace. As the above-mentioned high temperature non-oxidizing gas which is blown against the steel material, in order to prevent a drop of the furnace temperature and to prevent the steel material from being cooled in the midway of heating, the high temperature non-oxidizing gas is supplied by preheating to a temperature substantially equal to the furnace temperature, or to the steel material temperature or higher.

Figure 7:
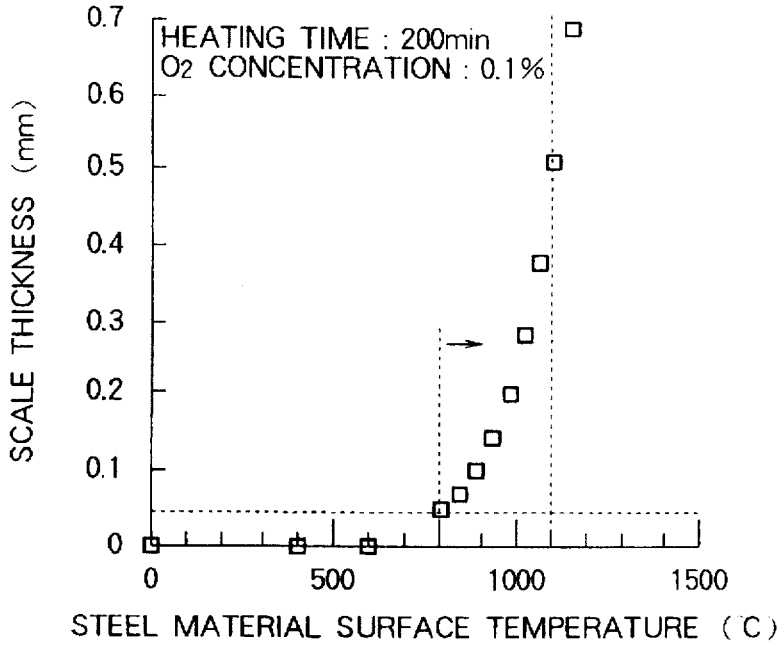
FIG. 7 is a graph showing a relationship between a steel material surface temperature in a heating furnace of steel materials and a thickness of a produced scale.

FIG. 7 shows shows a relationship between a steel material surface temperature within the steel material heating furnace and a scale production thickness, and when the steel material surface temperature exceeds 800° C., the oxidation rapidly progresses, and a scale thickness becomes 0.1 mm or larger. At this level of the scale thickness, the load of descaling process is increased, and the amount of scale is also increased resulting in a significant decrease of the yield.

Accordingly, in the present invention, in the injection of the non-oxidizing gas which covers the steel material surface, the non-oxidizing gas which is preheated to the atmosphere temperature within the furnace (furnace temperature) as described in the foregoing is directly blown onto the steel material in a region in which the temperature of the steel material is 800° C. or higher, preferably in a region of 700° C. or higher at which the oxidation progresses rapidly, alternatively, the non-oxidizing gas is supplied to the extent to allow to replace the oxidizing combustion gas produced within the furnace.

Figure 8:
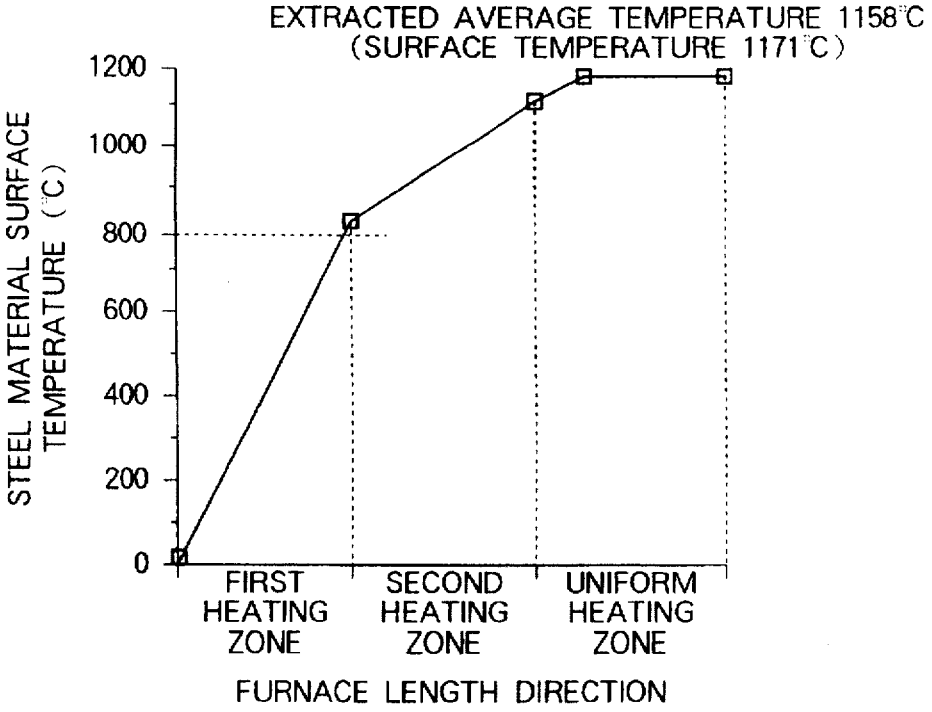
FIG. 8 is a graph showing a change of a steel material surface temperature in each zone in a walking beam type continuous heating furnace.

FIG. 8 shows a change of the steel material surface temperature in each zone (first heating zone, second heating zone, and uniform heating zone) in a walking beam type continuous heating furnace. The zones in which the temperature exceeds 800° C. at which the amount of scale generation increases are the second heating zone and the following zones, and in this meaning, a supply position of the high temperature non-oxidizing gas is preferably located between the second heating zone and the outlet side of the uniform heating zone.

As a supply method of the high temperature non-oxidizing gas, it is effective to inject from a side surface, a ceiling, or a furnace bottom towards the steel material to be heated to surround the same, or to blow into to replace the high temperature oxidizing combustion gas in the heating zone and the uniform heating zone so that the whole atmosphere within the furnace becomes non-oxidizing.

In this case, the high temperature non-oxidizing gas which is blown around the steel material is supplied from a system independent of a fuel system such as a burner which is fluctuated dependent of a thermal load of the furnace. Accordingly, it is important to always adjust the condition optimum for heating and the condition required for preventing oxidation thereby to obtain an optimum value, and to maintain this optimum value.

Furthermore, the high temperature non-oxidizing gas described above utilizes what is generated by heat exchange with the heating furnace combustion gas, in a non-oxidizing gas preheating apparatus as the non-oxidizing heating apparatus which is provided additionally to the heating furnace.

Figure 9:
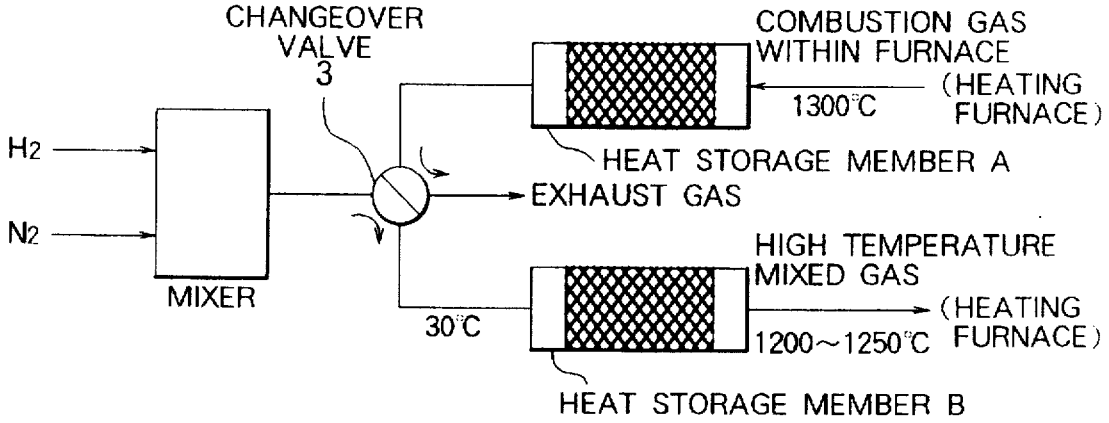
FIG. 9 is a conceptual diagram showing an embodiment in which the present invention is applied to non-oxidizing heating of a heating furnace of steel materials.

FIG. 9 shows a conceptual diagram of the non-oxidizing gas preheating apparatus, and a heat exchanger have heat storage members A and B, in which at least two heat storage members form a set. Either one (A) of the heat storage members A and B is used as a heat storage system, and the other heat storage member B of a high temperature (which has already been heated as the above-mentioned A) is used as a blower system which heats the non-oxidizing gas and blows this gas. Both the heat storage members A and B are used by changing over their roles alternately. As a heating means for heating the heat storage member of the heat storage system, a high temperature combustion exhaust gas (1300° C.) is utilized, and this gas is introduced into the heat storage member to heat the heat storage member. On the other hand, to the heat storage member of the blower system, for example, a non-oxidizing mixed gas ($N_2$+$H_2$, 30° C.) at normal temperature is introduced from an opposite direction to perform heat exchange thereby to generate a high temperature non-oxidizing gas (1200° to 1250° C.). The generated high temperature non-oxidizing gas in turn is blown into the heating furnace.

Both the heat storage members A and B are connected to a supply line of the non-oxidizing gas at normal temperature through a changeover valve 3, and the roles of the heat storage members A and B are changed over by the changeover valve 3 to sequentially perform the heat exchange so that the high temperature non-oxidizing gas is continuously generated by the heat exchanger of a burnerless structure.

In supplying the high temperature non-oxidizing gas mentioned above into the heating furnace, in order to prevent decrease and cancellation of the advantageous effects of the present invention due to mixing of the high temperature non-oxidizing gas with a combustion flame (oxidizing gas) of the burner, it is desirable to blow the high temperature non-oxidizing gas towards surroundings of the steel material so that a blow angle is in parallel with a flame axis of the heating burner as far as possible. Also it is desirable in this blowing to make the flow velocity substantially equal to a flame velocity of the heating burner.

Figure 10:
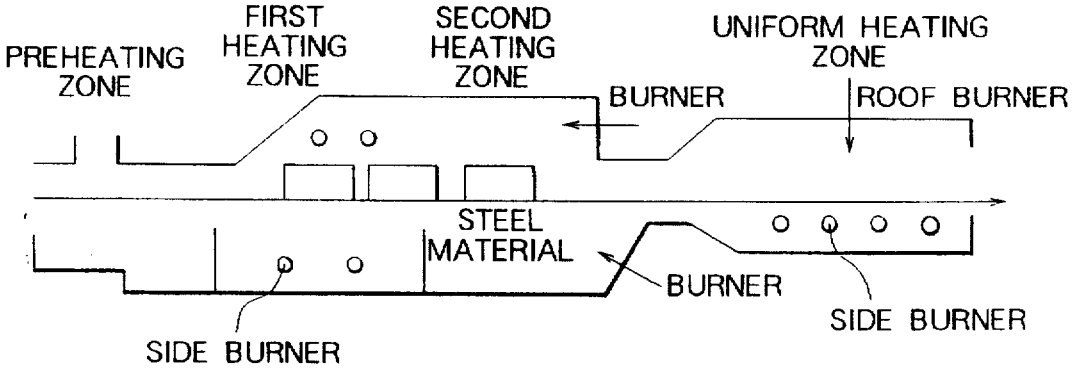
FIG. 10 is a schematic diagram showing outline of a heating furnace of steel materials.
Figure 11A:
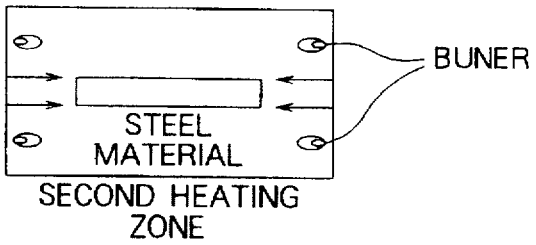
FIGS. 11*a* and 11*b* are schematic diagrams showing a manner of blast of a non-oxidizing gas in a heating zone and a uniform heating zone in a heating furnace of a steel material.
Figure 11B:
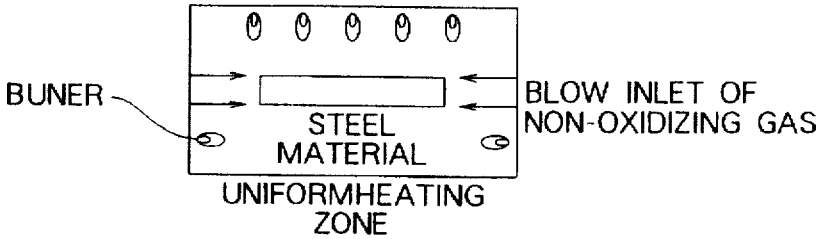

For example, in the case of a steel material heating furnace having a burner arrangement as shown in FIG. 10, in a second heating zone, the blowing is made from side walls as shown in FIG. 11 (*a*). Also, in a uniform heating zone, as shown in FIG. 11 (*b*), it is considered to employ a blowing method in which the blow is made from the side walls as well as from a position between burners. However, if there is no problem in the installation space of a blowing device, it is desirable to blow from a position between burners. As a blowing nozzle, a nozzle made from ceramics having various shapes may be used, however, it is easy to produce a completely non-oxidizing atmosphere around the steel material if the nozzle is located close to the steel material as far as possible, and the effect of suppressing oxidation is large.

As the flow rate of the non-oxidizing gas which is blown into, since it is possible to reduce the $O_2$ concentration relatively in a high temperature section by making the flow rate larger in the uniform heating zone side than in the heating zone side, the total oxidation suppressing effect becomes large.

Furthermore, in supplying the high temperature non-oxidizing gas into the uniform heating zone, since the steel material surface has been heated to a high temperature, even if the $O_2$ concentration in the atmosphere in this zone is set low, the oxidizing quantity is not decreased so much. On the other hand, the combustion load required for heating is small, and the capacity of burner is also small. In such a case, as compared with the direct blow of the non-oxidizing gas towards the surface of the steel material, it is better to replace the whole area within the zone (in this case, the whole area of the uniform heating zone) by a high temperature non-oxidizing gas to form a high temperature non-oxidizing gas atmosphere. This is also similarly applicable where only a small heating capability is needed due to the implementation of DHCR or the like.

In the non-oxidizing heating of a steel material within the heating furnace in the present invention, in order to generate a high temperature non-oxidizing gas which is higher than the furnace temperature, it is preferable to use the above-mentioned non-oxidizing gas preheating apparatus. However, other methods, for example, a non-transfer type plasma jet containing trace amounts of reducing gas may be used. However, in order to decrease the costs of an apparatus and for heating, it is the most preferable method to use the above-mentioned heat storage type non-oxidizing gas preheating apparatus which utilizes the combustion exhaust gas within the furnace.

Hereinafter, there are shown test examples in which the non-oxidizing heating method of steel material within a heating furnace in the present invention is contrasted with a prior art heating method.

(1) In a test example in which a hot rolling steel material is heated to 1150° C. in the walking beam type hot rolling heating furnace shown in FIG. 10, a high temperature non-oxidizing gas (mixed gas of $N_2$ and $H_2$) is generated by using the non-oxidizing Gas preheating apparatus as shown in FIG. 9. The generated gas, as shown in FIGS. 10 and 11, is blown into a second heating zone and a uniform heating zone respectively at a flow rate of ⅕ to 1/10 of a burner total combustion gas quantity, and an oxidizing thickness (mm) of the steel material is measured.

(2) In contrast to the above, an oxidizing thickness (mm) of the steel material is measured in the cases in which the steel material is heated by a normal heating method, a direct flame reduction heating method, and a two-layer atmosphere combustion method.

Figure 12:
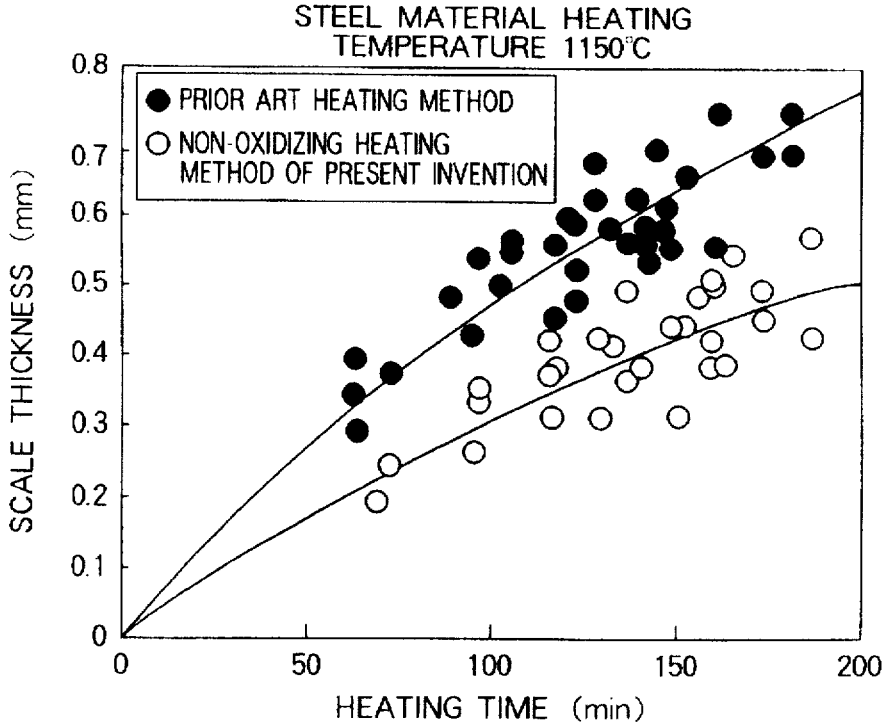
FIG. 12 is a graph showing a comparison in a scale decreasing effect between an embodiment in the non-oxidizing heating of heating furnace of a steel material and the prior art heating method.

The result of comparison in this test example is shown in FIG. 12. As shown in FIG. 12, a scale forming thickness can be decreased by about 40% by the non-oxidizing heating method in the present invention.

As described in the foregoing, it is the basic principle in the non-oxidizing heating technique of the present invention to repeat the operation of heating the non-oxidizing gas to a predetermined temperature while changing over alternately a plurality of heat storage type heaters, and to continuously supply the obtained high temperature non-oxidizing gas, thereby to heat the inside of the furnace which requires a non-oxidizing atmosphere by the high temperature non-oxidizing gas. Accordingly, as compared with the prior art, a high temperature oxidizing gas is not generated within the furnace, and the oxidation of an object to be heated can be completely prevented. As a result, the present invention is especially useful as the non-oxidizing heating technique in various furnaces such as a ladle, tundish, or the like, in the steel manufacturing and continuous casing field, and in various furnaces for heating metallic materials including non-ferrous metals in the heating and heat treatment field.

In particular, when a part of the obtained high temperature non-oxidizing gas is recirculated and re-used to heat the inside of the furnace, or when waste heat of the combustion gas within the furnace is utilized for preheating of the heat storage type heater, the heat can be effectively utilized, and it is suitable to decrease the operation cost.

Furthermore, the non-oxidizing heating technique is particularly suitable for heating a tundish which requires a non-oxidizing atmosphere. In this case, in re-using a tundish having residual steel produced on an inner wall, it is possible to omit preheating by combustion gas within the tundish by using a preheating burner which has been performed in the prior art, so that the oxidation of the residual steel within the tundish is completely prevented and the occurrence of defective quality of the product steel can be prevented. In addition, it is possible to increase the number of successive operations by extending the stand-by enabling time at the time of re-use of the tundish to a great extent as compared with the prior art.

Furthermore, the non-oxidizing heating technique of the present invention is also suitable for a heating furnace of a steel material. In this case, it is possible to omit the prior art non-oxidizing heating method of heating furnace such as a radiant tube method, a direct flame reduction heating method, a two layer atmosphere combustion method, and the like in which sufficient prevention of oxidation has been difficult due to many restrictions such as combustion conditions, etc. It is also possible to stabilize the atmosphere on the steel material surface within the heating furnace, and to maintain the atmosphere in a completely non-oxidizing atmosphere, and to realize the decrease of scale loss and to improve the yield of products.

Moreover, it is also suitable for an annealing furnace. In this case, in place of the indirect heating by the prior art radiant tube burner, the convection heat transfer heating by the high temperature gas jet is performed, and it is possible to significantly improve the plate temperature controllability of an object to be heated such as, for example, a strip.

We claim:

1. A non-oxidizing heating method characterized in that in heating the inside of a furnace which requires a non-oxidizing atmosphere by a high temperature non-oxidizing gas, an operation to heat a non-oxidizing gas to between 1200° to 1300° C. is repeated while changing over a plurality of heat storage type heaters alternately, and the obtained high temperature non-oxidizing gas is continuously supplied.

2. A non-oxidizing heating method according to claim 1, wherein a part of the high temperature non-oxidizing gas supplied into said furnace is recirculated for re-use to heat the inside of the furnace.

3. A non-oxidizing heating method according to claim 1, wherein said high temperature non-oxidizing gas supplied into the furnace is generated by heat exchange with a combustion gas within the furnace, said heat exchange being performed through said heat storage type heaters.

4. A non-oxidizing heating method according to claim 1, wherein said furnace which requires a non-oxidizing atmosphere is a tundish.

5. A non-oxidizing heating method according to claim 4, wherein in re-using said tundish having residual steel developed on an inner wall thereof, the heat within said tundish is preserved by using a non-oxidizing gas which has been heated to 850° C. or higher by a heating means external to said tundish.

6. A non-oxidizing heating method according to claim 1, wherein said furnace which requires a non-oxidizing atmosphere is a heating furnace for a steel material.

7. A non-oxidizing heating method according to claim 6, wherein a high temperature non-oxidizing gas, which is preheated to a temperature not lower than a temperature of the steel material being heated or to a temperature substantially equal to a temperature of the furnace, is supplied around the steel material in said heating furnace.

8. A non-oxidizing heating method according to claim 7, wherein the supply of the high temperature non-oxidizing gas into the heating furnace is performed by a method of blowing to the vicinity of the steel material to surround the steel material in the heating zone in which a surface temperature of the steel material exceeds 700° C. or in the uniform heating zone, or by a method of replacing an oxidizing gas within the furnace by the high temperature non-oxidizing gas by the blowing.

9. A non-oxidizing heating method according to claim 1, wherein said furnace which requires a non-oxidizing atmosphere is an annealing furnace.

10. A non-oxidizing heating method according to claim 1, wherein trace amounts of reducing gas equal to an explosion limit or less is introduced into the furnace in addition to the non-oxidizing gas to change the atmosphere within the furnace to a non-oxidizing or reducing atmosphere.

11. A non-oxidizing heating method according to claim 10, wherein as said non-oxidizing gas, a sole $N_2$ or Ar, or a mixture of $N_2$ and Ar is used, and as said reducing gas, a sole $H_2$ or CO, or a mixture or $H_2$ and CO is used.

12. A non-oxidizing heating method according to claim 2, wherein said high temperature non-oxidizing gas supplied into the furnace is generated by heat exchange with a combustion gas within the furnace, said heat exchange being performed through heaters having a storage body.

13. A non-oxidizing heating method according to claim 2, wherein said furnace which requires a non-oxidizing atmosphere is a tundish.

14. A non-oxidizing heating method according to claim 3, wherein said furnace which requires a non-oxidizing atmosphere is a tundish.

* * * * *